United States Patent [19]

Courtois et al.

[11] Patent Number: 4,942,718

[45] Date of Patent: Jul. 24, 1990

[54] PROCESS FOR THE PACKAGING OF LIDS

[75] Inventors: Michel Courtois, Saint Gratien; Jacques Fillon, Chelles, both of France

[73] Assignee: Cebal, Clichy, France

[21] Appl. No.: 199,787

[22] Filed: May 27, 1988

[30] Foreign Application Priority Data

Jun. 17, 1987 [FR] France ..... 87 08894

[51] Int. Cl.[5] ..... B65B 3/12; B65B 5/06; B65B 7/28; B65B 39/06

[52] U.S. Cl. ..... 53/435; 53/254; 53/447; 53/471; 53/473; 53/520; 53/532; 53/541

[58] Field of Search ..... 53/435, 447, 473, 513, 53/520, 541, 241, 242, 243, 254, 532, 471; 83/90, 91, 97

[56] References Cited

U.S. PATENT DOCUMENTS

| | | | |
|---|---|---|---|
| 1,098,061 | 5/1914 | Spiller | 53/513 X |
| 1,463,229 | 7/1923 | Simmons | 83/97 |
| 2,119,561 | 6/1938 | Smith | 53/447 |
| 2,433,535 | 12/1947 | Treis et al. | 83/97 X |
| 2,556,214 | 6/1951 | Pottle | 53/541 |
| 3,261,500 | 7/1966 | McGlynn | 53/447 X |
| 3,466,833 | 9/1969 | Penrod et al. | 53/447 X |

FOREIGN PATENT DOCUMENTS

| | | | |
|---|---|---|---|
| 542433 | 6/1957 | Canada | 53/447 |

*Primary Examiner*—Robert L. Spruill
*Assistant Examiner*—Beth Bianca
*Attorney, Agent, or Firm*—Dennison, Meserole, Pollack & Scheiner

[57] ABSTRACT

The process according to the invention relates to the packaging of lids cut out in a press combined with a stacker. According to the process, the guide rods of a delivery magazine are covered by a substantially cylindrical casing which simultaneously surrounds the stacked lids while at the same time immobilizing the stack transversely to itself with a slight clearance therebetween, the casing comprising support means for resting on the moving supports at the bottom of the stack of lids and stop means for retaining the bottom of the stack borne by the casing. The retaining means are optionally completed by one or more associated retaining means. The stack of lids covered in this way is then removed from the delivery magazine and the casing is sealed with caps which offer an added measure of protection.

5 Claims, 3 Drawing Sheets

PROCESS FOR THE PACKAGING OF LIDS

The present invention relates to a process for the packaging of lids which are cut out in a press with lid stacker equipped with a delivery magazine defined at the sides by guide rods. The invention also relates to the corresponding packaging system and to the casing for protecting the stacked lids, which is used in this process and in this system.

A press with lid stacker comprising single or multiple lid cutting tool(s) and one or more delivery "channels" or magazines corresponding to the cutting lines, in which the lids are pushed one by one to form one or more stacks is known from the journal "Emballage et Conditionnement", November 1976, page 65. In this method, each stack is manually extracted from the guide rods forming the delivery channel or magazine once it reaches an adequate height, usually less than 10 cm. According to the abovementioned document, the lids can be stacked directly in a loader which is then removed with the lids which it contains and is replaced on the machine by an empty loader.

The lids under consideration are usually used for food containers containing, for example, yoghurts or creams. In the earlier process or system, the lids are contaminated as the result of contact with bare hands or gloves during handling and, moreover, the stacks or piles of lids currently obtained in a delivery magazine are not maintained as such in the further handling and transportation from the press with stacker to the customer's packaging machine and, in addition, the numbers of lids delivered are unknown.

The applicant has attempted to overcome these disadvantages, that is to say to develop a packaging process and system allowing the delivery of lids without contamination and preferably lids in counted stacks of a height which can be much greater than in the prior art.

STATEMENT OF THE INVENTION

The invention firstly relates to a packaging process in which, as known:

(a) the lids are cut out in a press equipped with a delivery magazine defined by guide rods;

(b) these lids are pushed outside the cutting tool into the delivery magazine where they form a stack which rests by its base on moving supports;

(c) said stack is extracted outside said delivery magazine.

According to the invention:

(b1) during or after stage (b), the guide rods of the delivery magazine are covered or have been covered by the substantially cylindrical portion of a casing, and this portion surrounds or will surround said stack of lids while immobilizing it transversely to said portion with a slight clearance and comprises means for resting on said moving supports as well as means for retaining the bottom of the stack;

(b2) after covering the stack of lids with said cylindrical portion, one or more retaining means co-operating with said means for retaining the bottom of the stack borne by said portion are optionally installed;

(c) the stack covered in this way by the cylindrical portion of the casing is extracted from said delivery magazine, the guide rods contained between the stack of lids and the cylindrical portion of the casing thus being released from said covered stack by the translation movement of this stack.

(c1) the top and bottom ends of said cylindrical portion are each capped with a cap, the two caps fixed in this way completing the protective casing;

(d) The stack of lids thus contained in said protective casing is then handled.

If the retaining means borne by the substantially cylindrical portion of the casing are perforations allowing said portion to be traversed by a retaining rod or blade, stage (b2) involves positioning this rod or blade which will support the stack of lids during the extraction operation (c1). Such retaining means are not used in practice unless the thickness of the cylindrical portion is greater than 0.8 mm.

According to a variation, the substantially cylindrical portion of the casing is in two parts which are separate or are articulated with a hinge zone between them and are provided with suitable closure or fixing means. In stage (b1) the stack of lids and the guide rods of this substantially cylindrical portion which is in two parts or foldable and is usually obtained by shaping, typically by heat forming, are thus covered and this portion is closed by fixing it by means of its closure or fixing means. The support means consist of compartments which thus rest on the moving supports located at the base of the delivery magazine, and the retaining means which are intended to support the stack of lids as it is extracted from the delivery magazine and is handled consist of internal bumps on said portion situated at the top of the support compartments or slightly lower. Such a shaped portion is usually composed of plastics material having a thickness of 0.2 to 0.5 mm, typically of one of the materials from the group including PVC, cellulose acetate, polystyrene.

In a manner which is advantageous for the production of lids in stacks which are protected by a casing according to the invention and can be much higher than in the prior art and are preferably constituted by a known number of lids:

according to stage (b) and before stage (b1), the lids are pushed into an intermediate magazine or stacking chamber where a stack of lids is formed, then the stack formed in this way is ejected into the delivery magazine The lids are preferably counted as they are being cut out and the stack of lids is ejected into the delivery magazine when the number of lids selected for this stack is attained.

The use of an intermediate magazine for stacking the lids allows this stack, on the one hand, and the covering and the extraction of the protected stack of lids from the delivery magazine, on the other hand, to be effected in concealed time, which is useful for productivity. If the cylindrical portion of the casing is of a type which can be installed by sliding along the guide rods, it can be placed in the front covering position during or after the ejection of the stack of lids in the delivery magazine. The introduction of lid counting and of the stoppage of the stack when the number of lids selected for the stack is reached allows production of stacks of lids in predetermined numbers which are reproducible from one stack to another, the stacks being protected and remaining intact during handling and transportation.

This handling and transportation typically end with the placing of the lids in an input magazine of the customer's packaging machine. This input magazine is defined by guide rods surrounding and immobilizing the stack of lids in the same way as the guide rods of the delivery magazine of the cutting press with stacker. If the guide rods of this input magazine are arranged in the same way as the guide rods of this delivery magazine, or are at least inscribable in the substantially cylindrical portion of the casing, the covered stack of lids is introduced into the input magazine after having at least its bottom end cap removed, and, in succession, the top cap is removed if it has not already been removed and the cylindrical portion is extracted, after extracting the retaining means if necessary. The stack of lids is thus ready for the packaging procedure and has avoided contamination since the lid cutting operation in the press with stacker.

The invention relates secondly to a lid packaging system comprising, after the cutting tools of a press with stacker, means for conveying the lids towards a delivery magazine, and to this delivery magazine which is defined at the sides by guide rods and at its base by moving supports. According to the invention, this packaging system also includes a casing comprising a substantially cylindrical portion surrounding said guide rods and the stack of lids contained in said delivery magazine so as to immobilize this stack transversely to said cylindrical portion with a slight clearance, means for supporting said portion on said moving supports and means for retaining the stack of lids as well as one or two end cap(s), this casing allowing the stack of lids to be protected when it is extracted from the delivery magazine and during subsequent handling.

According to an advantageous variation, the protective casing forming part of this system comprises a cylindrical portion obtained by extrusion, its means for resting on the moving supports being cut-outs or notches in an end section of said portion, and its means for retaining the stack of lids contained being perforations combined with a rod or blade traversing said cylindrical portion through these perforations. The cylindrical portion of the casing can thus be arranged in advance on the delivery magazine before introducing or forming the stack of lids. This cylindrical portion is typically composed of extruded plastics material having a thickness of from 1 to 2 mm, for example of PVC or of polystyrene, and the end caps are also typically composed of plastics material.

According to a second variation, the protective casing comprises a substantially cylindrical portion in two parts which are separate or can be folded round a hinge zone, as described with reference to the process and as illustrated in one of the examples.

For mass production, the conveying means in the packaging system according to the invention preferably comprise an intermediate stacking chamber defined by the tools and/or by the guide rods, means for pushing the cut-out lids into this stacking chamber, means for counting the lids, means for ejecting the stack formed in said chamber into the delivery magazine and means for controlling this ejection when the number of lids selected for the stack is reached The means for pushing the lids one by one from the cutting tool to the stacking chamber and the means for ejecting the stack of lids can thus be different or, in an advantageous solution, they are formed by the same ejector which passes through the cutting tools and through the means for controlling the course of this ejector. The longitudinal axis of the magazine is typically vertical or is inclined by less than 45° to the vertical The invention relates thirdly to the casing for packaging the stack of lids and the two variations thereof described above.

The process, the packaging casing and the system of which it forms part thus provide stacks of lids protected from contamination from the moment they are cut out to the packaging machine, for example a machine for filling with a food product. The process and the system according to the invention also allow larger stacks of lids which are preferably pre-counted to be produced.

EXAMPLES

FIG. 1 shows an example of an arrangement of a packaging system according to the invention.

FIGS. *2a*, *2b*, *2c* show a first casing according to the invention.

1ST EXAMPLE: ARRANGEMENT OF A PACKAGING SYSTEM ACCORDING TO THE INVENTION

Figure 1:
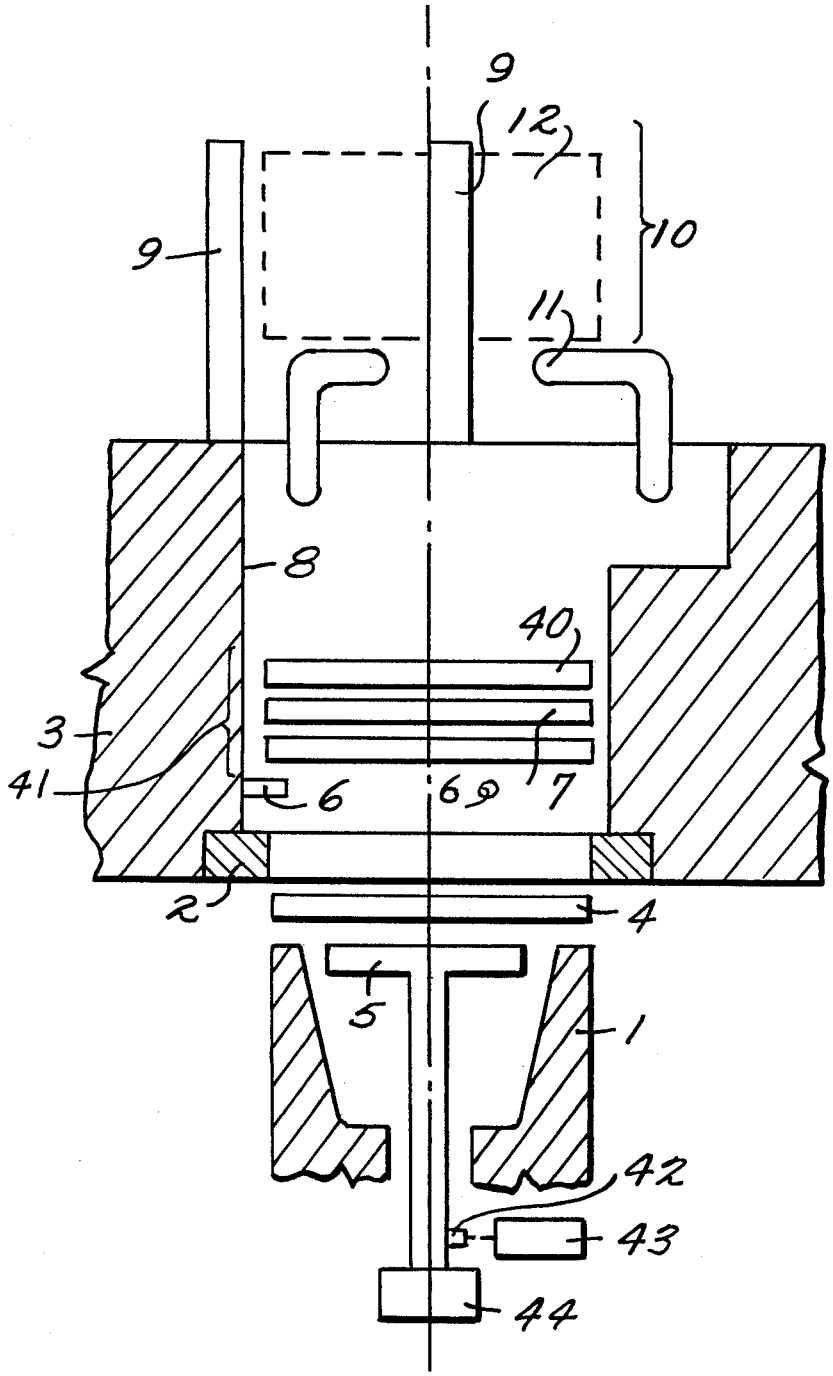

FIG. 1, which shows schematically the arrangement of the cutting means and the packaging means, shows the cutting tools 1, 2 comprising a moving circular or annular punch 1 and an appropriate die 2 fixed on a support 3, the punch 1 raising the blank (not shown) which is cut into a lid 4 by shearing between the external lateral edge of this punch 1 and the die 2.

For the sake of clarity, the punch 1 and the cut out lid 4 are shown behind the die 2. An ejector 5 passes through the punch 1 and raises each cut out lid 4 until it reaches some catches 6 which are fixed on the die support 3 and bite by about 0.6 mm in diameter in the periphery of the lid 4 which will clear these catches 5 by local deformation and will thus be located at the bottom of the intermediate magazine or stacking chamber 7. This chamber 7 is defined at the sides by a bore 8 in the support 3 and by the bottom of the three guide rods 9 of the delivery magazine 10 fixed on the support 3.

Some lids such as 40 are already present in the stacking chamber 7, and the beginning of the stack 41 which they form increases by the base until the counting of the short movements of the ejector 5 by the counting means 42 and 43, these movements transporting the lids such as 4 until they clear the catches 6 with corresponding raising of the beginning of the stack 41, reaches the number N of lids preselected for the stacks of lids to be delivered.

The ejector 5 then automatically performs a long movement driven by its controlling means 44, in order to transport the complete stack of N lids into the delivery magazine 10 while clearing, with the entire stack, the rocking supports or fingers 11 which then return to the closed position in which they support the stack of lids 12, the contour of which is shown schematically here by a broken line.

The substantially cylindrical portion of the protective casing according to the invention is positioned round the guide rods 9 either by surrounding the guide rods 9 and the stack of lids 12 in the casing of a portion in two parts which are separate or are articulated to one another or by a translation movement along the guide rods in the casing of one cylindrical portion, this translation movement thus taking place before or after introduction of the stack 12 into the delivery magazine 10.

2ND EXAMPLE: FIRST CASING ACCORDING TO THE INVENTION (FIGS. 2a-2b-2c)

Figure 2A:
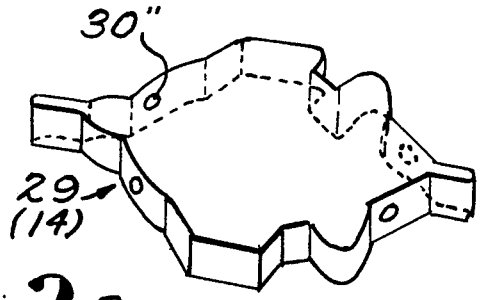
Figure 2B:
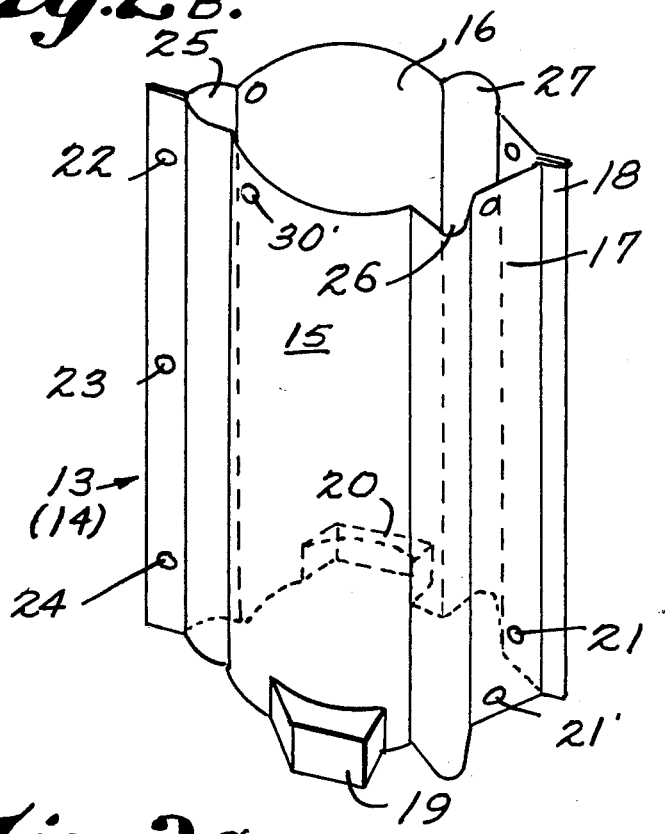
Figure 2C:
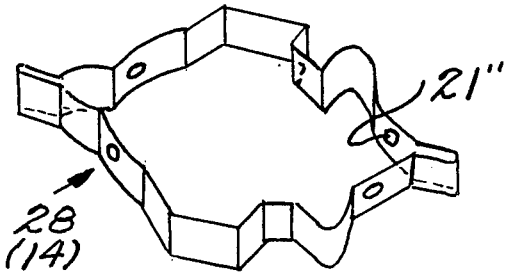

The substantially cylindrical portion or body 13 of the casing 14 in FIG. 2*a* comprises two parts 15 and 16 which are articulated to one another round a hinge zone 17 centered on a longitudinal folding edge 18 and it comprises two lower external compartments 19 and 20 intended to cap the moving supports 11 for the stack of lids 12 (FIG. 1) during the covering operation. This portion 13 also bears four internal bumps such as 21, which are obtained by permanent deformation of the wall and correspond to hollows in the external surface These bumps or bulbs 21 located slightly below the top of the compartments 19 and 20 act as means for retaining the stack of lids covered by the portion 13 when it is being extracted from the delivery magazine.

The two parts 15 and 16 of the casing portion 13 are closed by clipping at three points 22, 23 and 24. They thus comprise three longitudinal compartments 25, 26, 27 which are to surround externally the guide rods 9 (FIG. 1), one of these compartments 25 being produced by closing the portion 13.

The external hollows 21' corresponding to the internal bumps 21 serve for fixing the lower cap 28 (FIG. 2*c*) by nesting, this cap 28 bearing similar bumps 21'. The upper cap 29 (FIG. 2*a*) has the same shape as the lower cap 28, the two caps are interchangeable, and the top of the casing portion 13 and the cap 29 bear fixing reliefs 30' and 30'' similar to the reliefs 21' and 21'.

3RD EXAMPLE: SECOND CASING ACCORDING TO THE INVENTION (FIGS. 3 AND 4)

Figure 4:
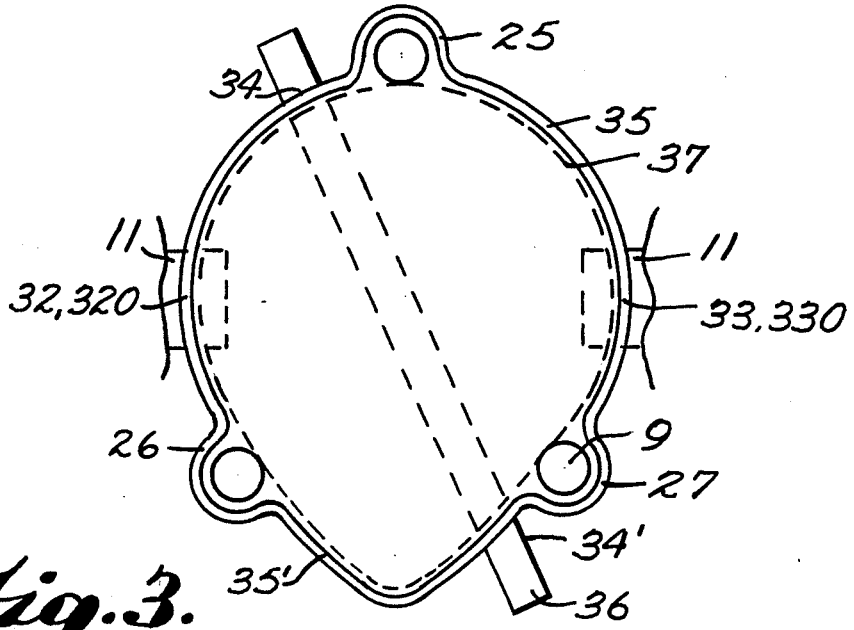
FIG. 4 shows, in section, the cylindrical portion of this second casing arranged on a delivery magazine.
Figure 3:
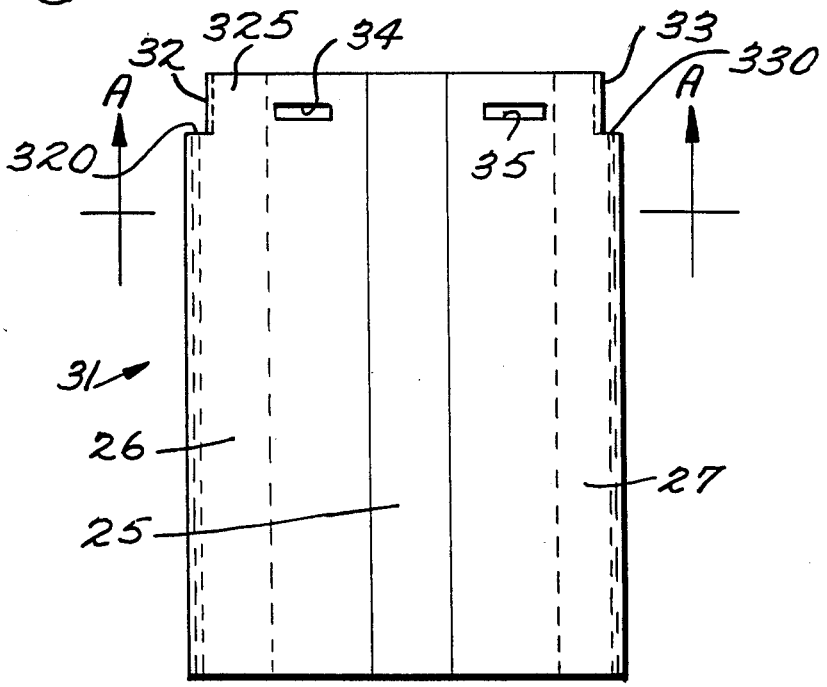
FIG. 3 shows the cylindrical portion of a second casing according to the invention.

The cylindrical portion 31 of this second casing has, as the portion 13 of the first casing, three longitudinal compartments 25, 26, 27 externally surrounding the guide rods 9 (FIG. 4). It has as means for resting on the moving supports 11 of the delivery magazine, two U-shaped notches 32 and 33 in its wall in its end part 325, the bases 320 and 330 of these notches thus resting on the supports 11 when the casing is placed on the delivery magazine by sliding round the guide rods 9 (FIGS. 3 and 4). The portion 31 also has two pairs of opposing incisions 34, 34' and 35, 35' allowing a traversing retaining blade 36 to be threaded just below the stack of lids resting on the moving supports 11, the doubling of these incisions allowing the operator to use the incision best positioned for him as first incision 34. FIG. 4 shows how the cylindrical portion 31 contains the contour 37 (dotted line) of the lids, independently of the three guide rods 9 and with a slight clearance, of from 0.5 to 0.8 mm in diameter in this casing, according to the zones between the longitudinal compartments 25, 26, 27.

This casing body 31 can be positioned on the delivery magazine before, while or after it is filled with lids, allowing flexibility for interventions by the operator. After extraction of the casing body 31 filled with lids, the casing body 31 is provided with end caps which are fitted by force or by suitable fixing means. In this example, the casing body 31 is composed of extruded PVC having a thickness of 1.5 mm, its overall dimensions in a cross-section are 92×68.5 mm and its total height is 132 mm, the height of its support notches 32 and 33 being 10 mm. Its incisions 34 to 35' are located at 8.5 mm from its upper end, they have a height of 1.2 mm and a unit width or length of 10 mm, the retaining blade 36 used being composed of stainless steel, having rounded corners and measuring 95×8.5×1 mm.

EXAMPLE OF USE OF THIS SECOND CASING

This casing has been used with aluminium lids having a thickness of 0.04 mm which have been embossed and decorated to give them an apparent thickness of 0.08 mm, having the contour 37 shown in FIG. 4 corresponding to a 68 mm diameter circle joined to a radiated right-angled sector (radius of 5 mm). The lids are packaged in stacks of 1,500 pre-stacked lids counted automatically in the stacking chamber of the machine, weighing 585 g and having a height of 120 mm, in cases equipped with caps, and are handled as such until they are placed on the customer's packaging machine described above, for which the casing prevents contamination of the lids.

What is claimed is:

1. A process for the packaging of lids, comprising the steps of:

(a) cutting out from blank material lids in a press equipped with a fixed delivery magazine defined at the sides thereof by guide rods;

(b) conveying by a pushing motion the lids beyond the cutting tool and into the delivery magazine such that the lids form a stack which is supported at its base by movable supports;

(c) covering both the guide rods of the delivery magazine and the stacked lids in the magazine with a substantially cylindrical casing, portions of which surround the guide rods such as to immobilize the stacked lids within an transversely of the casing with a slight clearance;

(d) positioning the casing on the movable supports;

(e) retaining the stacked lids in position upon internal extensions formed on said casing adjacent the base thereof;

(f) extracting the stacked lids and the casing from the delivery magazine;

(g) covering the top and bottom ends of the casing with caps thereby sealing the casing to protect the stacked lids from contamination; and (h) handling the casing and lids stacked therein for transportation and delivery.

2. A process according to claim 1, wherein following the application of the casing to the guide rods to cover said stacked lids, applying at least one rod or blade through perforations in the cylindrical portion of the casing so as to support the stack of lids during extraction from the delivery magazine.

3. A process according to claim 1, wherein the casing is formed by two portions which are separated or articulated by a hinge and which are closed by a suitable fixing means and wherein the means for retaining the stack consist of bumps formed on the inside of the casing walls.

4. A process according to claims 1, 2, or 3, wherein prior to application of the casing to the delivery magazine, the lids are pushed one by one into a stacking chamber after which the stack of lids formed in this way is ejected into the delivery magazine.

5. A process according to claim 4, wherein the lids are counted as they are being transferred from the cutting tools to the stacking chamber and the stack of lids is ejected into the delivery magazine when the number of lids selected for this stack is reached.

* * * * *

UNITED STATES PATENT AND TRADEMARK OFFICE

CERTIFICATE OF CORRECTION

PATENT NO. : 4,942,718

DATED : July 24, 1990

INVENTOR(S) : Michel Courtois et al

It is certified that error appears in the above-identified patent and that said Letters Patent is hereby corrected as shown below:

Column 6, line 33, "within an" should be -- within and --.

Signed and Sealed this

Seventh Day of January, 1992

*Attest:*

HARRY F. MANBECK, JR.

*Attesting Officer*

*Commissioner of Patents and Trademarks*